US011279137B2

(12) United States Patent
Govyadinov et al.

(10) Patent No.: US 11,279,137 B2
(45) Date of Patent: Mar. 22, 2022

(54) DROPLET EJECTORS AIMED AT TARGET MEDIA

(71) Applicant: HEWLETT-PACKARD DEVELOPMENT COMPANY, L.P., Spring, TX (US)

(72) Inventors: Alexander Govyadinov, Corvallis, OR (US); Pavel Kornilovich, Corvallis, OR (US); Diane R Hammerstad, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/606,761

(22) PCT Filed: Jul. 17, 2018

(86) PCT No.: PCT/US2018/042406

§ 371 (c)(1),
(2) Date: Oct. 20, 2019

(87) PCT Pub. No.: WO2020/018072

PCT Pub. Date: Jan. 23, 2020

(65) Prior Publication Data

US 2021/0331482 A1 Oct. 28, 2021

(51) Int. Cl.

| | |
|---|---|
| ***B41J 2/175*** | (2006.01) |
| ***B41J 2/07*** | (2006.01) |
| ***B41J 2/14*** | (2006.01) |

(52) U.S. Cl.
CPC ..... *B41J 2/17513* (2013.01); *B41J 2/07* (2013.01); *B41J 2/14* (2013.01)

(58) Field of Classification Search
CPC ..... B41J 2/17513; B41J 2/14; B41J 2/07
See application file for complete search history.

(56) References Cited

U.S. PATENT DOCUMENTS

| | | | | |
|---|---|---|---|---|
| 5,635,966 | A | 3/1997 | Keefe et al. | |
| 6,332,665 | B1 * | 12/2001 | Mantell | B41J 13/226 347/16 |
| 6,547,354 | B1 * | 4/2003 | Askeland | B41J 2/2132 347/12 |
| 7,086,724 | B2 * | 8/2006 | Silverbrook | H04N 5/225 347/86 |

FOREIGN PATENT DOCUMENTS

| | | | | |
|---|---|---|---|---|
| EP | 1486220 | A1 | 12/2004 | |
| EP | 3081385 | A1 * | 10/2016 | B32B 37/12 |
| EP | 3081385 | B1 | 6/2017 | |
| JP | 4701765 | B2 | 6/2015 | |
| WO | WO2015138648 | A1 | 9/2015 | |
| WO | WO2016193758 | A1 | 12/2016 | |

* cited by examiner

*Primary Examiner* — Bradley W Thies
(74) *Attorney, Agent, or Firm* — Perry + Currier Inc

(57) ABSTRACT

An example device includes a first substrate including a first array of droplet ejectors to eject droplets of a first fluid. The example device further includes a first target medium immovably positioned relative to the first substrate to receive droplets of the first fluid from a first subset of droplet ejectors of the first array of droplet ejectors. A second subset of droplet ejectors of the first array of droplet ejectors is positioned to eject droplets of the first fluid to miss the first target medium.

15 Claims, 9 Drawing Sheets

DROPLET EJECTORS AIMED AT TARGET MEDIA

BACKGROUND

Droplet ejection is used for a variety of purposes, such as printing ink to paper and dispensing of other types of fluid to a surface. In many applications, a printhead is attached to a scanning mechanism, and a control system controls the scanning mechanism to move the printhead, in one or two dimensions relative to a two-dimensional target surface, so that the printhead may eject droplets of fluid at different locations on the target surface. It is also common for the target surface to be moved, as is the case for sheets of paper that are advanced past a printhead. For example, in an inkjet printer, a scanning mechanism may move the printhead across the width of a page while the page is advanced in the direction of its length.

DETAILED DESCRIPTION

An array of droplet ejectors and a target medium are mutually positioned such that a droplet ejector of the array ejects droplets that miss the target medium, and such droplets may be aimed to impinge another target medium or other component. A target medium may be held immovable with respect to the array of droplet ejectors. Hence, different target media may be provided with droplets of fluid without needing to move the array of droplet ejectors or a target medium. A printhead scanning mechanism and related control system may be omitted.

An array of droplet ejectors and a target medium may be provided in a one-to-one relationship, a one-to-many relationship, a many-to-one relationship, or a many-to-many relationship.

An elongate droplet-ejector array and an elongate target medium may have any spatial relationship. That is, they may be positioned and angled with respect to each other in three dimensions.

An array of droplet ejectors may be used to deliver chemical, biological, or biochemical reagents to the target medium.

An array of droplet ejectors and a target medium may be combined in a one-time-use or consumable package. The lack of a printhead scanning mechanism and related control system may reduce the complexity of implementing such a disposable device.

Figure 1A:
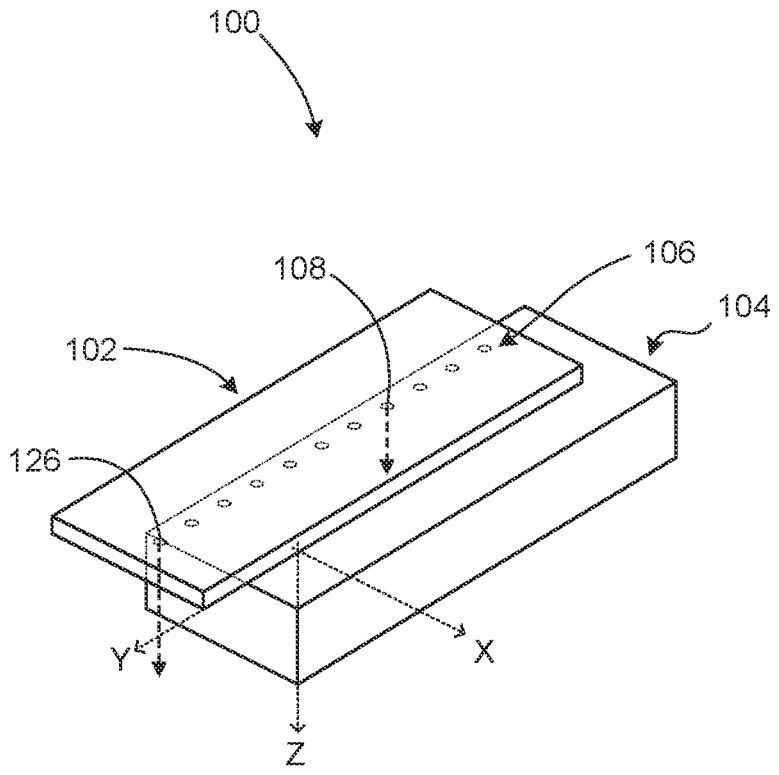
FIG. 1A is a perspective view of an example device including an array of droplet ejectors having a droplet ejector aimed to direct droplets to a target medium and another droplet ejector aimed to miss the target medium.

FIG. 1A shows an example device 100. The device 100 includes a droplet-ejector substrate 102 and a target medium 104. The substrate 102 includes an array of droplet ejectors 106 to eject droplets of fluid to the target medium 104. The array of droplet ejectors 106 is shown schematically as an array of nozzle orifices. In the present example, the array of droplet ejectors 106 may be arranged in an XY plane and droplet ejection may generally be in a Z direction. The array of droplet ejectors 106 may take any geometry, such as linear, rectangular, curved, circular, or other XY pattern. Spacing of droplet ejectors in the array may be regular or irregular. The target medium 104 is offset from the substrate 102 in the Z direction, such that a gap containing air or other gas exists between the target medium 104 and the substrate 102. Droplets ejected from the array of droplet ejectors 106 traverse the gap and impinge the target medium 104.

The substrate 102 and the target medium 104 may be planar and parallel. For example, the substrate 102 and the target medium 104 may have respective surfaces parallel to the XY plane, as depicted.

The substrate 102 may be elongate in shape and may, for example, have an elongate axis that extends in a Y direction. The target medium 104 may be elongate in shape and may, for example, have an elongate axis that extends in the Y direction. The elongate axes of the substrate 102 and the target medium 104 may be parallel, as depicted.

The substrate 102 may have multiple layers. The substrate 102 may include silicon, glass, photoresist, and similar materials.

Figure 1B:
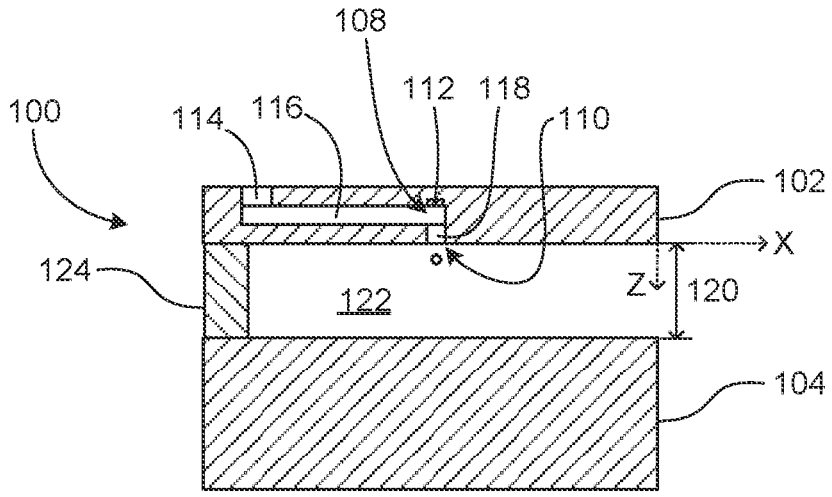
FIG. 1B is a cross-sectional view of the example device of FIG. 1A, as viewed along a Y axis.
Figure 1C:
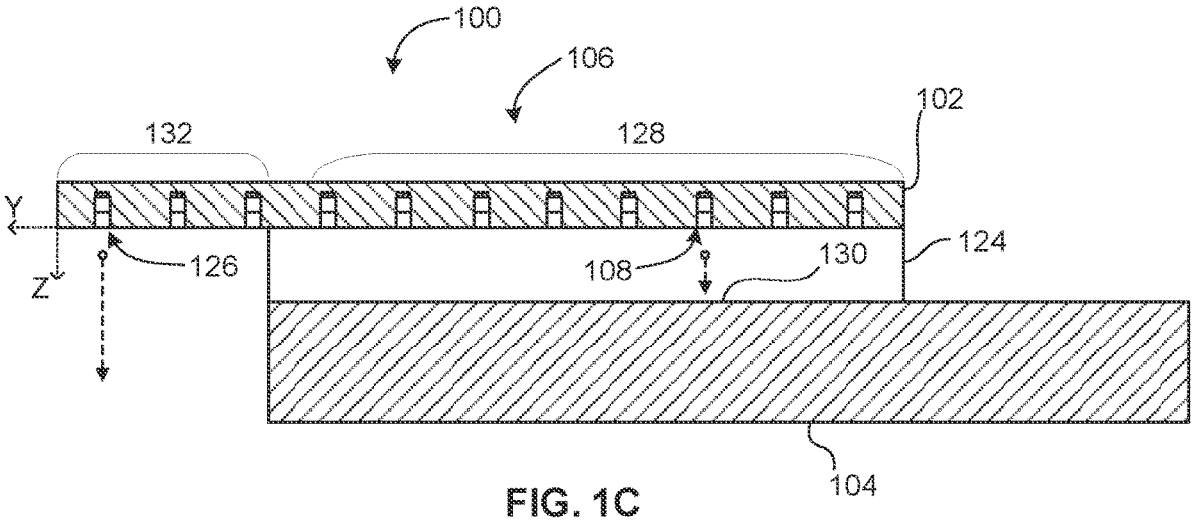
FIG. 1C is a cross-sectional view of the example device of FIG. 1A, as viewed along an X axis.

As shown in FIG. 1B, which shows the device 100 from the end, a droplet ejector 108 of the array of droplet ejectors 106 includes a nozzle 110 to eject droplets of fluid towards the target medium 104. The droplet ejector 108 may include a jet element 112, such as a resistive heater, a piezoelectric element, or similar. The jet element 112 is controllable to draw fluid from an inlet 114 and through a channel 116 that feeds the ejector 108, so as to jet fluid droplets through an orifice 118. Any number of droplet ejectors 108 may be provided to a head, which may be referred to as a reagent dispenser or consumable, and such a device may employ inkjet droplet jetting techniques, such as thermal inkjet (TIJ) jetting.

The other droplet ejectors of the array of droplet ejectors 106 may be analogous, similar, or identical to the droplet ejector 108.

The fluid provided to the droplet ejector 108 may be a reagent, such as a chemical solution, a sample (e.g., a deoxyribonucleic acid or DNA sample), or other material. The term "fluid" is used herein to denote a material that may be jetted, such as aqueous solutions, suspensions, solvent solutions (e.g., alcohol-based solvent solutions), oil-based solutions, or other materials.

The target medium 104 is positioned to receive droplets of the fluid from the droplet ejector 108. The target medium may be separated from the droplet ejector 108 by a gap 120 to be traversed by the droplets. A volume 122 exists between the substrate 102 that carries the droplet ejector 108 and the target medium 104.

The target medium 104 may be provided with a reagent, sample, or similar material to undergo a biological, chemical, or biochemical process with a reagent, sample, or similar material provided by droplets ejected by the droplet ejector 108.

The target medium 104 may include a passive medium. Examples of passive target media include a strip or other structure of porous material, paper, foam, fibrous material, micro-fibers, and similar. A passive target medium may include a network of microfluidic channels, which may be made of silicon, photoresist (e.g., SU-8), polydimethylsiloxane (PDMS), cyclic olefin copolymer (COC), other plastics, glass, and other materials that may be made using micro-fabrication technologies. Fluid deposited by droplets ejected by the droplet ejector 108 may be conveyed by capillary action by a passive target medium. In other examples, a passive target medium may be non-porous. A passive medium may contain a fluid that receives droplets of ejected fluid. That is, droplets of an ejected fluid may be ejected into another fluid that is contained by a passive medium. Similarly, a passive medium may contain a solid compound that receives droplets of ejected fluid. A solid compound may be solid in bulk, may be a powder or particulate, may be integrated into a fibrous material, or similar.

The target medium 104 may include an active medium. Examples of active target media include a substrate having a mesofluidic or microfluidic structure. An active target medium may include an active microfluidic component, such as a pump, sensor, mixing chamber, channel, heater, reaction chamber, droplet ejector, or similar to perform further action on fluid delivered by droplets ejected by the droplet ejector 108.

The device 100 may further include a frame 124 (omitted from FIG. 1A for clarity) to affix the target medium 104 to the substrate 102 that carries the array of droplet ejectors 106. As such, the target medium 104 may be immovably held with respect to the array of droplet ejectors 106. The substrate 102, target medium 104, and frame 124 may be integrated together as a disposable cartridge having a unitary package, which may be disposed after use. The substrate 102, target medium 104, and frame 124 may be permanently held together by adhesive, material deposition (e.g., deposition of photoresist onto a silicon substrate), an interference or snap fit, over-molding of the frame 124 to the substrate 102 and/or target medium 104, or similar technique. The frame 124 may enclose the volume 122 between the substrate 102 and the target medium 104.

The frame 124 affixing the target medium 104 to the substrate 102 that carries the array of droplet ejectors 106 prevents relative motion of the target medium 104 and the array of droplet ejectors 106 and may eliminate the need for a scanning mechanism and related control system or similar mechanism.

With reference back FIG. 1A, the substrate 102 may be positioned with respect to the target medium 104, such that a first subset of droplet ejectors of the array of droplet ejectors 106 ejects fluid to impinge the target medium 104 and a second subset of droplet ejectors of the array of droplet ejectors 106 is positioned to eject droplets to miss the target medium 104. The droplet ejector identified at 108 is a member of the first subset of droplet ejectors and the droplet ejector 108 is aimed towards the target medium 104. A droplet ejector 126 is a member of the second subset of droplet ejectors and is aimed to eject droplets that miss the target medium 104. Droplets that miss the target medium 104 may impinge another component, such as another target medium, a waste collector, or other structure positioned relative to the target medium 104. That is, the substrate 102 may be intentionally misaligned with the target medium 104 so that an additional component may be used to receive droplets.

In the example shown in FIG. 1A, the substrate 102 is shifted with respect to the target medium 104 in the Y direction. In other examples, a substrate 102 may be positioned at other distances along the X, Y, and Z axes and at other angles with respect to the X, Y, or Z axes relative to the target medium 104, such that a droplet ejector is aimed towards the target medium 104 and another droplet ejector is aimed to miss the target medium 104.

Figure 10:
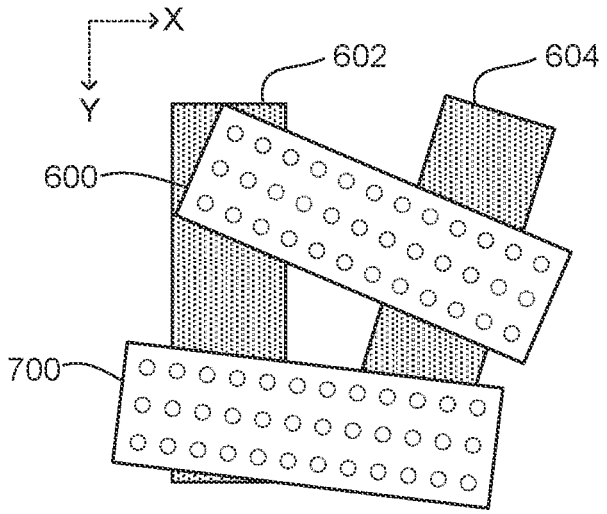
FIG. 10 is a plan view of an example arrangement of droplet ejector-carrying substrates and target media showing different relative orientations.

FIG. 10 shows the device 100 from the side. A first subset 128 of the array of droplet ejectors 106 is aimed to eject droplets to a target region 130 of the target medium 104. A second subset 132 of the array of droplet ejectors 106 is aimed to miss the target region 130 of the target medium 104.

In operation, the droplet ejectors 108, 126 of the array of droplet ejectors 106 may be controlled to eject droplets of fluid at various rates, which may be varied over time. Droplets may impinge onto the target medium 104 and droplets may miss the target medium 104 and may impinge onto another component. A reaction or other process at the target medium 104 may be performed using fluid provided by a droplet ejector 108 that is aimed towards the target medium 104 and the same or a different reaction or other process may be performed using fluid provided by a droplet ejector 126 that is aimed to miss the target medium 104.

Example applications of the device 100 include a polymerase chain reaction (PCR), a real-time or quantitative polymerase chain reaction (qPCR), reverse transcription polymerase chain reaction (RT-PCR), loop mediated isothermal amplification (LAMP), and similar.

Figure 2:
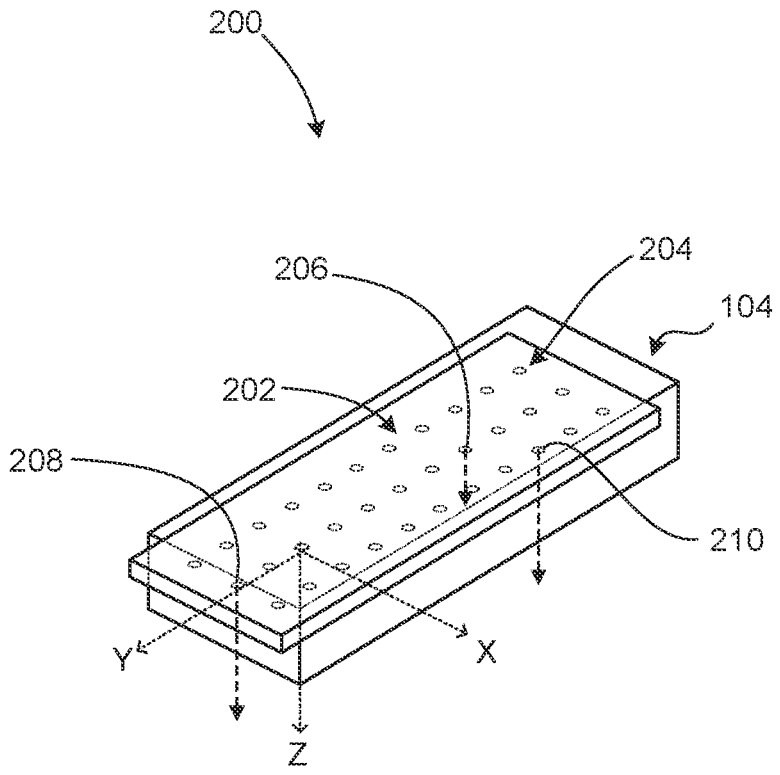
FIG. 2 is a perspective view of an example device including an array of droplet ejectors having droplet ejectors offset in two dimensions, such that a subset of droplet ejectors is aimed towards the target medium and another subset of droplet ejectors is aimed to miss the target medium.

FIG. 2 shows an example device 200. Features and aspects of the other devices and systems described herein may be used with the device 200 and vice versa. Like reference numerals denote like elements and description of like elements is not repeated here.

The device 200 includes a droplet-ejector substrate 202 and a target medium 104. The substrate 202 includes an array of droplet ejectors 204 to eject droplets of fluid to the target medium 104. The array of droplet ejectors 204 is shown schematically as an array of nozzle orifices. The array of droplet ejectors 204 may be arranged in an XY plane and droplet ejection may generally be in a Z direction. The array may be regular or irregular array of any geometry. In this example, the substrate 202 is offset with respect to the target medium 104 in the X and Y directions. The target medium 104 may be immovably held with respect to the substrate 202.

A first subset of droplet ejectors of the array of droplet ejectors 204 includes a droplet ejector 206 that ejects droplets that hit the target medium 104. A second subset of droplet ejectors of the array of droplet ejectors 204 includes a droplet ejector 208 that ejects droplets that miss the target medium 104. The droplet ejector 208 is positioned to overhang the target medium 104 in the Y direction. The second subset further includes another droplet ejector 210 that ejects droplets that miss the target medium 104. The droplet ejector 210 is positioned to overhang the target medium 104 in the X direction.

The positioning shown is illustrative of the fact that the array of droplet ejectors 204 may be arranged in an XY plane and positioned with respect to the target medium 104, such that any quantity of droplet ejectors may be aimed at the target medium 104 and any quantity of droplet ejectors may be aimed to miss the target medium 104.

As will be discussed in detailed below, droplets that miss the target medium 104 may be used at another component, such as another target medium.

Figure 3:
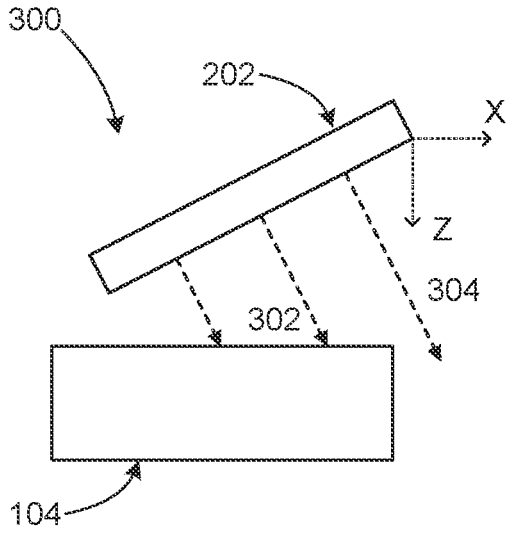
FIG. 3 is an end view of an example device having a substrate angled with respect to a target medium, such that a subset of droplet ejectors is aimed towards the target medium and another subset of droplet ejectors is aimed to miss the target medium.

FIG. 3 shows an example device 300. Features and aspects of the other devices and systems described herein may be used with the device 300 and vice versa. Like reference numerals denote like elements and description of like elements is not repeated here.

The device 300 includes a droplet-ejector substrate 202 and a target medium 104. The substrate 202 includes an array of droplet ejectors to eject droplets of fluid to the target medium 104. The substrate 202 may be angled with respect to the target medium 104 about a Y axis, as depicted. In other examples, the substrate 202 may be angled with respect to the target medium 104 about another axis, such as an X axis or an axis having XY, XZ, YZ, or XYZ non-zero components. The angle of the substrate 202 with respect to the target medium 104 may be an angle between 0 and 90 degrees, recognizing that larger angles may cause a greater amount of ejected fluid to miss the target medium 104. The array of droplet ejectors may be arranged in the plane of the substrate 202. The target medium 104 may be immovably held with respect to the substrate 202.

Accordingly, a first subset of droplet ejectors has a trajectory 302 that hits the target medium 104 and a second subset of droplet ejectors has a trajectory 304 that misses the target medium 104.

The positioning shown is illustrative of the fact that the array of droplet ejectors may be tilted with respect to the target medium 104 at any angle. Accordingly, with reference to FIGS. 2 and 3, an array of droplet ejectors may be positioned and tilted with respect to a target medium in with six degrees of freedom in three-dimensional space, such that a droplet ejector is aimed to impinge droplets onto the target medium and another droplet ejector is aimed to miss the target medium and may be aimed at another component.

Figure 4:
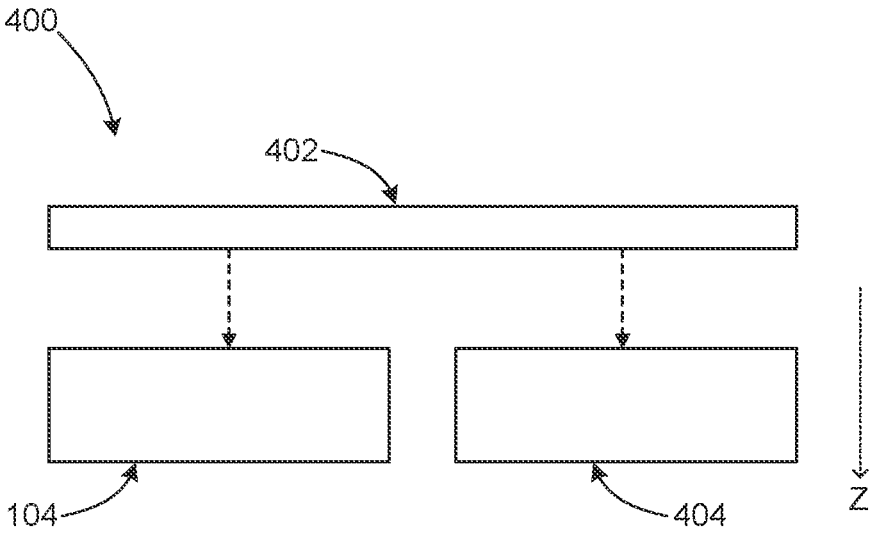
FIG. 4 is a side view of a substrate having droplet ejectors aimed to direct droplets to different target media.
Figure 5:
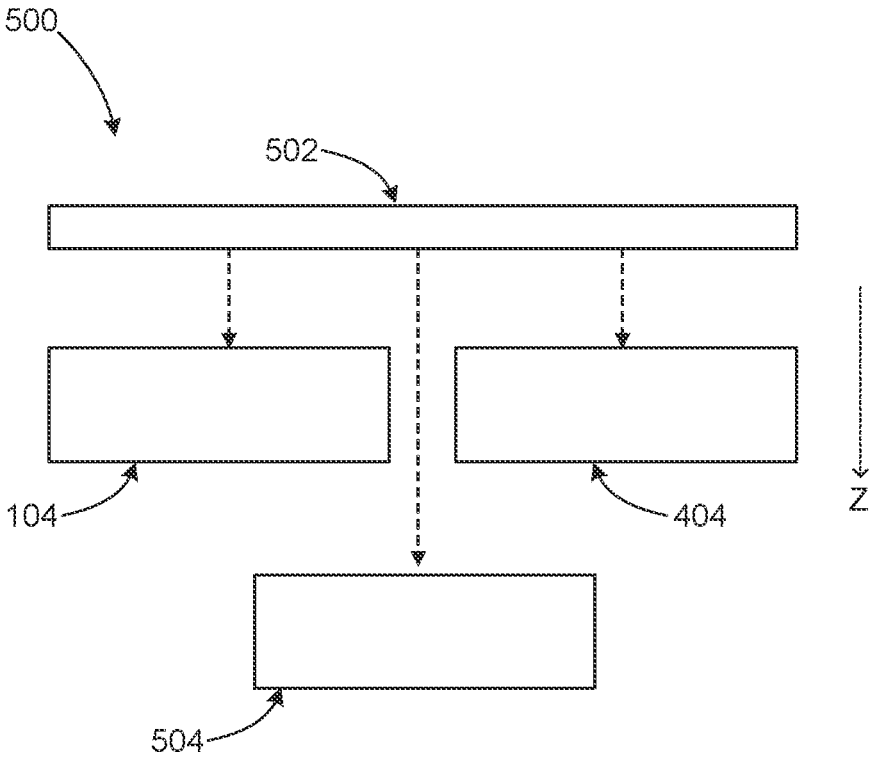
FIG. 5 is a side view of a substrate having droplet ejectors aimed to direct droplets to different target media at different distances from the substrate.

FIGS. 4 and 5 show example devices 400, 500. Features and aspects of the other devices and systems described herein may be used with the devices 400, 500 and vice versa. Like reference numerals denote like elements and description of like elements is not repeated here.

The device 400 includes a droplet-ejector substrate 402 and a plurality of target media 104, 404. The substrate 402 includes an array of droplet ejectors to eject droplets of fluid to the target media 104, 404.

The plurality of target media 104, 404 may include a first target medium 104 and a second target medium 404. The first target medium 104 is positioned relative to the substrate 402 to receive droplets of fluid ejected from a first subset of the droplet ejectors. The second target medium 404 is positioned relative to the substrate 402 to receive droplets of fluid ejected from a second subset of the droplet ejectors that are aimed to miss the first target medium 104. Accordingly, an array of droplet ejectors provided to a substrate may distribute fluid to a plurality of different target media.

The second target medium 404 may be a component that is analogous, similar, or identical to the first target medium 104.

The device 500 includes a droplet-ejector substrate 502 and a plurality of target media 104, 404, 504. The substrate 502 includes an array of droplet ejectors to eject droplets of fluid to the target media 104, 404, 504. A target medium 504 may be a different Z position than another target medium 104, 404.

FIGS. 6-12 show various example arrangements of droplet ejectors and target media. Features and aspects of the other devices and systems described herein may be used with these examples and vice versa. Like reference numerals denote like elements and description of like elements is not repeated here. Droplet ejectors are shown schematically as nozzle orifices in hidden line.

Figure 6:
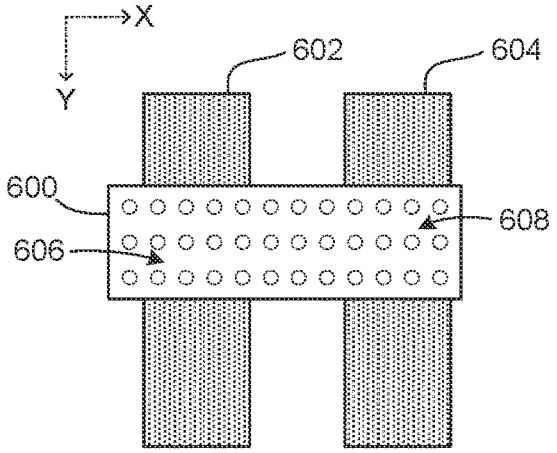
FIG. 6 is a plan view of an example one-to-many arrangement of a droplet ejector-carrying substrate to target media, in which droplet ejectors are aimed with respect to the target media.

As shown in FIG. 6, substrate 600 includes an array of droplet ejectors, a first target medium 602, and a second target medium 604. A first subset of droplet ejectors 606 is aimed at the first target medium 602, so that droplets are provided to the first target medium 602. The second target medium is positioned relative to the substrate 600 to receive droplets that miss the first target medium 602. That is, a second subset of droplet ejectors 608 may be aimed towards the second target medium 604. This is an example of a one-to-many relationship of droplet-ejector array to target media.

The substrate 600 may be elongate and may extend in an X direction. The first target medium 602 may be elongate and may extend in a Y direction. That is, elongate axes of the substrate 600 and the first target medium 602 may be non-parallel, for example, perpendicular. The second target medium 604 may be elongate and may also extend in the Y direction.

Figure 7:
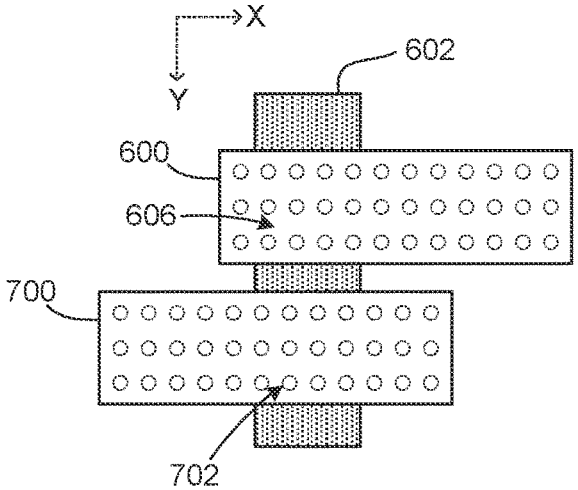
FIG. 7 is a plan view of an example many-to-one arrangement of droplet ejector-carrying substrates to a target medium, in which droplet ejectors are aimed with respect to the target medium.

As shown in FIG. 7, a many-to-one relationship of droplet-ejector arrays to target medium may be employed. A first substrate 600 and a second substrate 700 may have respective arrays of droplet ejectors that include respective subset of droplet ejectors 606, 702 that are aimed towards the same target medium 602.

The first substrate 600 may deliver a first fluid and the second substrate 700 may deliver a second fluid. The first and second fluids may be different.

The first and second fluids may be chemically, biologically, or biochemically similar, identical, or equivalent but may have a differing characteristic. Example differing characteristics include temperature, viscosity, surface tension, concentration of solids, concentration of surfactants, or similar. For example, the fluids may be the same aqueous solution at two different concentrations.

Figure 8:
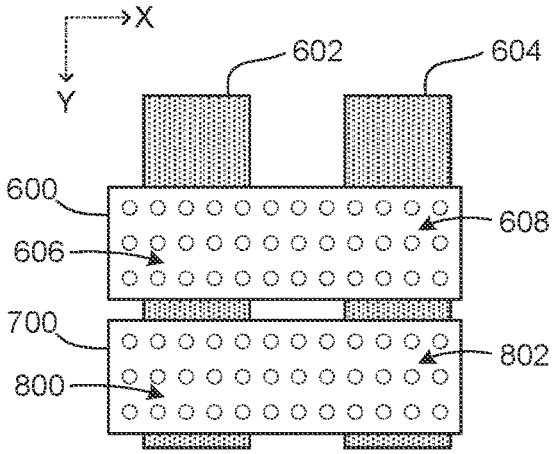
FIG. 8 is a plan view of an example many-to-many arrangement of droplet ejector-carrying substrates to target media, in which droplet ejectors are aimed with respect to the target media.

As shown in FIG. 8, a plurality of substrates 600, 700 and a plurality of target media 602, 604 are provided in an example of a many-to-many relationship of droplet-ejector arrays to target media.

A first subset of droplet ejectors 606 of a first substrate 600 is aimed at a first target medium 602. A second subset of droplet ejectors 608 of the first substrate 600 is aimed at a second target medium 604.

A second substrate 700 includes a second array of droplet ejectors and may be positioned relative to the first target medium 602 and the second target medium 604. A third subset of droplet ejectors 800 of the second array of droplet ejectors may be aimed to the first target medium 602. A fourth subset of droplet ejectors 802 of the second array of droplet ejectors may be positioned to miss the first target medium 602. The fourth subset of droplet ejectors 802 may be aimed towards the second target medium 604.

Figure 9:
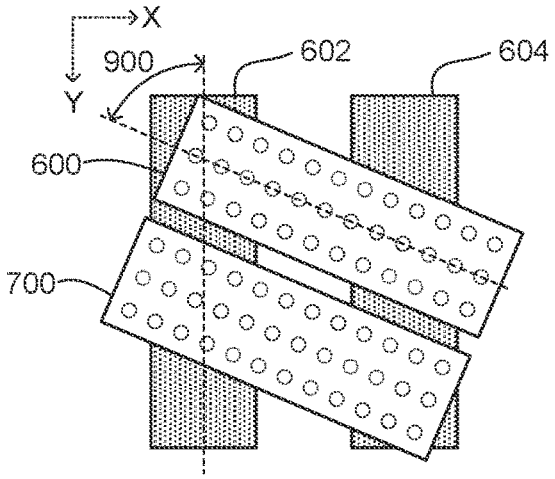
FIG. 9 is a plan view of an example arrangement of droplet ejector-carrying substrates and target media where a substrate is angled with respect to a target medium.

As shown in FIG. 9, elongate axes of an elongate first substrate 600 and an elongate first target medium 602 may be non-parallel by, for example, forming an angle 900 that is greater than 0 degrees and less than 180 degrees. In this example, the angle 900 is about a Z axis that is perpendicular to a plane of the substrate 600 or the target medium 602. The same may apply to a second substrate 700 and a second target medium 604.

As shown in FIG. 10, relative orientation among any number of droplet ejector-carrying substrates 600, 700 and any number of target media 602, 604 may be varied.

Figure 11:
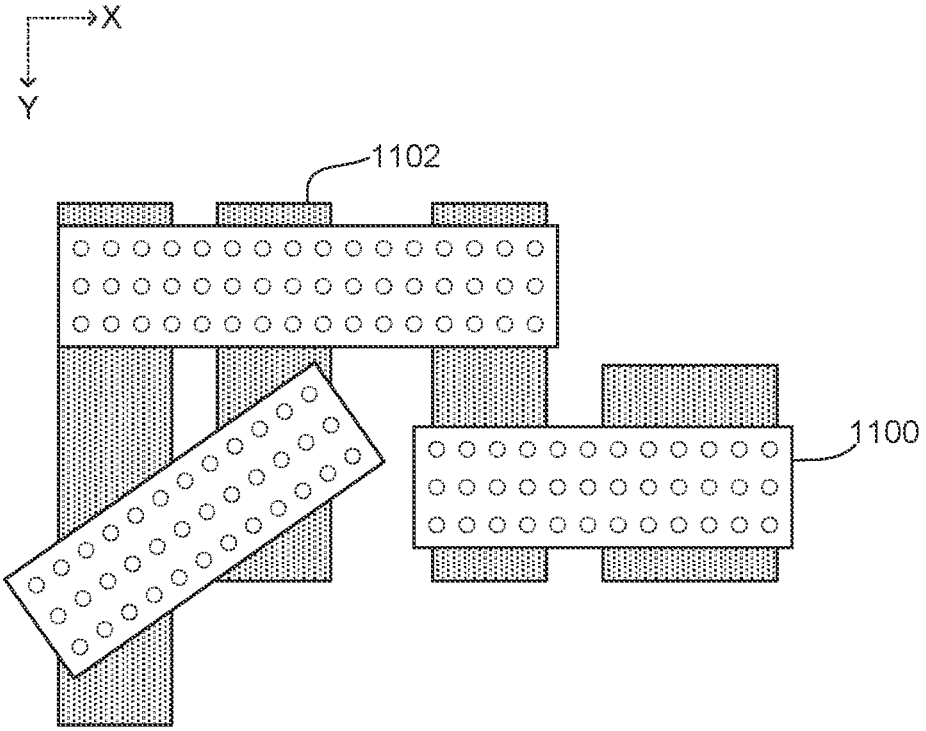
FIG. 11 is a plan view of an example complex arrangement of droplet ejector-carrying substrates and target media, in which a subset of droplet ejectors is aimed towards a target medium and another subset of droplet ejectors is aimed to miss the target medium.

As shown in FIG. 11, various complex arrangements of droplet ejector-carrying substrates 1100 and target media 1102 are possible. Any quantity, shape, size, position, and orientation of droplet ejector-carrying substrates 1100 may provide droplets of any flow rate and type of fluid to any quantity, shape, size, position, and orientation of target media 1102.

Figure 12:
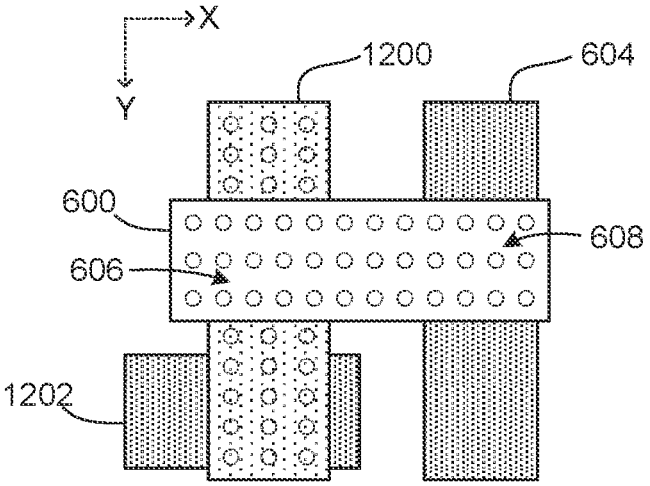
FIG. 12 is a plan view of an example arrangement, in which droplet ejectors are aimed with respect to target media, and a target medium carries droplet ejectors for ejection to a further stage.

As shown in FIG. 12, a substrate 600 includes an array of droplet ejectors aimed towards a first target medium 1200 and a second target medium 604. The first target medium 1200 includes additional droplet ejectors. The first target medium 1200 is positioned relative to the substrate 600 to receive droplets that miss the second target medium 604. The droplet ejectors at the first target medium 1200 may be used to eject fluid to a third target medium 1202, which may also have further droplet ejectors. This shows that second and further stages of droplet ejection may be used to deliver fluid to various arrangements of substrates and target media. With reference to FIGS. 6-11, any of the target media discussed may include droplet ejectors to eject fluid to a further stage, so as to facilitate three-dimensional fluid delivery via droplet ejection.

Timing of droplet ejection may be controlled to implement a process that uses fluid delivered from an initial stage to a final stage of a plurality of stages. Ejectors of a particular stage may be controlled to eject fluid to a subsequent stage. A time thereafter, ejectors of the subsequent stage may be controlled to eject fluid to another subsequent stage, and so on. Delay between stages may be controlled to permit the inflow and outflow of fluid used by a stage.

Figure 13:
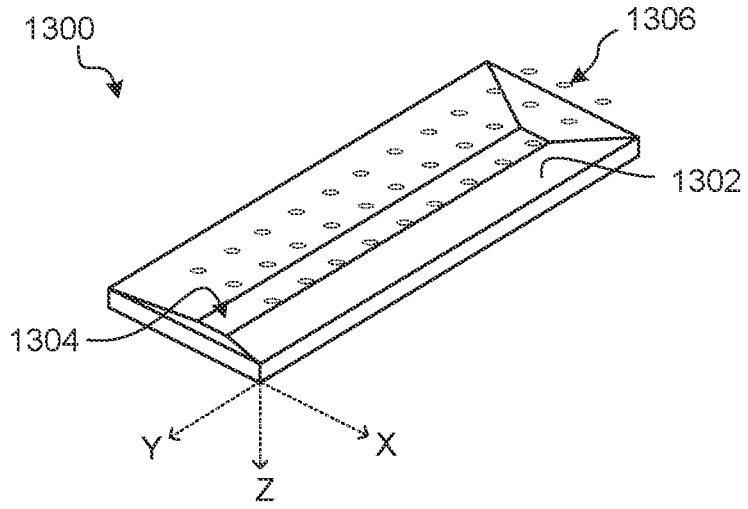
FIG. 13 is a perspective view of an example funnel to guide flow of droplets aimed with respect to a target medium.

FIG. 13 shows a perspective view of an example funnel 1300. The funnel 1300 may be used to guide droplets in flight and coalesced droplets as liquid towards a target region on a target medium.

With reference to FIG. 1B, the funnel 1300 may be positioned near or in place of a frame 124, that is, between a substrate 102 that carries an array of droplet ejectors 106 and a target medium 104. The funnel 1300 may affix the target medium 104 to the substrate 102. The funnel 1300 may hold the target medium 104 and the array of droplet ejectors 106 immovable with respect to one another.

In this example, the funnel 1300 includes four planar surfaces 1302 that narrow to a funnel outlet 1304 that may be located at a target region of a target medium. In other examples, other surface geometry may be used, such as a curved surface. The funnel may or may not be symmetrical.

An array of droplet ejectors 1306 positioned with respect to the funnel is shown schematically. Droplets that do not directly traverse from the ejectors to the funnel outlet 1304 may coalesce on a surface 1302 and then flow as a liquid towards the outlet 1304.

Figure 14:
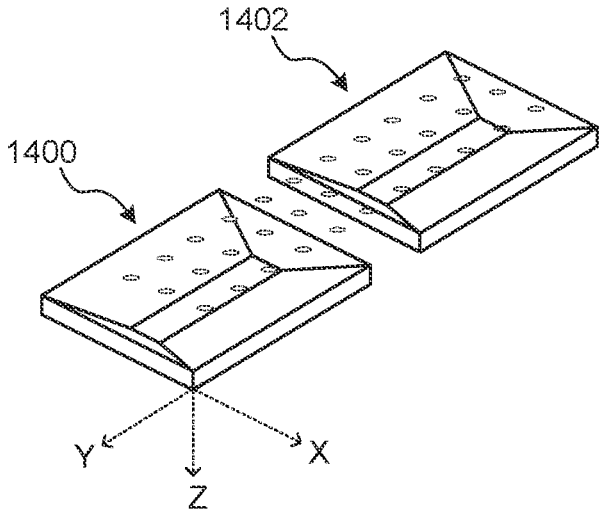
FIG. 14 is a perspective view of a plurality of example funnels to guide flow of droplets aimed with respect to target media.

As shown in FIG. 14, a plurality of funnels 1400, 1402 may be used to guide fluid from a plurality arrays of droplet ejectors or a plurality of subsets of droplet ejectors to different target media. For example, with reference to FIG. 6, a first funnel 1400 may be provided to a first subset of droplet ejectors 606 and a second funnel may be provided to a second subset of droplet ejectors 608.

Figure 15:
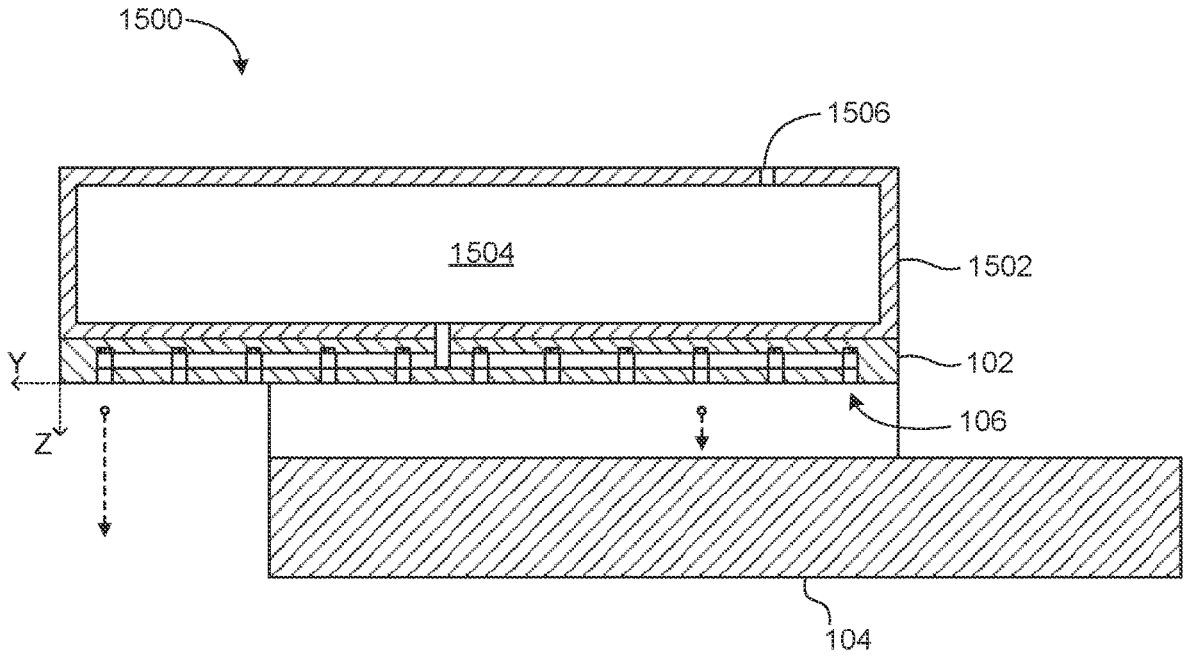
FIG. 15 is a cross-sectional view of an example device with a fluid reservoir and an array of droplet ejectors aimed with respect to a target medium.

FIG. 15 shows an example device 1500. Features and aspects of the other devices and systems described herein may be used with the device 1500 and vice versa. Like reference numerals denote like elements and description of like elements is not repeated here.

The device 1500 may include a fluid reservoir 1502 defining a fluid volume 1504 to supply fluid to an array of droplet ejectors 106 at a substrate 102. The fluid reservoir 1502 may include an end region of a slot in the substrate 102, and such a slot may convey fluid from a user-fillable or factory-finable reservoir, fill cup, or similar volume to the array of droplet ejectors 106 to be ejected to impinge upon and to miss a target medium 104.

The fluid reservoir 1502 may be preloaded with fluid. That is, the fluid volume 1504 may be filled at time of manufacture or otherwise before use of the device 1500. As such, the device 1500 may be a ready-to-use consumable device.

In other examples, a plurality of fluid reservoirs 1502 may be provided to feed fluid to different droplet ejectors of the array of droplet ejectors 106.

A fluid reservoir 1502 may include a fill port to allow filling of fluid after manufacture, just prior to use, or in similar situations. For example, the device 1500 may provide for the analysis of a biological sample and a fill port may be used to provide the sample to the device 1500.

A fluid reservoir 1502 may include a vent to allow outside air or other gas to enter the fluid reservoir 1502 as fluid is ejected, so as to relieve negative pressure that may be caused by fluid being drawn from the fluid volume 1504. The vent may include an opening, a permeable membrane, a bubbler, or similar structure that may resist the intrusion of outside contaminants while allowing for pressure equalization. A fill port may act as a vent.

An example fill port or vent is shown at 1506.

Figure 16:
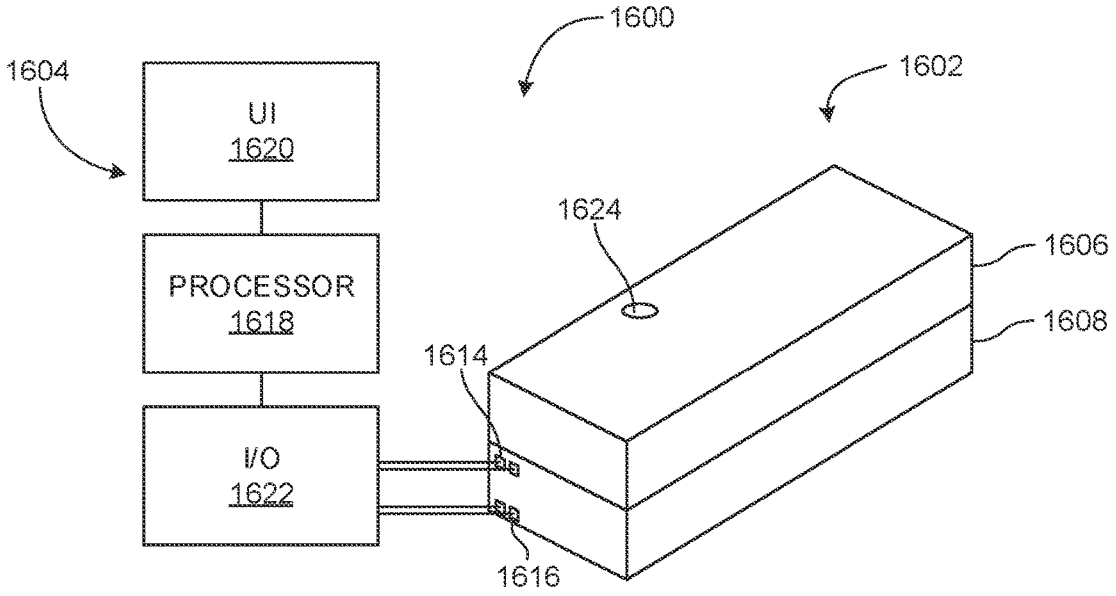
FIG. 16 is a schematic view of an example system including an example control device and an example cartridge including an arrangement of droplet ejectors aimed with respect to a target medium.

FIG. 16 shows an example system 1600. Features and aspects of the other devices and systems described herein may be used with the system 1600 and vice versa. Like reference numerals denote like elements and description of like elements is not repeated here.

The system includes a cartridge 1602 and a control device 1604. The cartridge 1602 may be a disposable cartridge that may be discarded after use.

The disposable cartridge 1602 may be similar or identical to any of the devices described elsewhere herein. The disposable cartridge 1602 may include a fluid reservoir 1606 and an arrangement 1608 including a droplet-ejector array and a target medium. The fluid reservoir 1606 may feed a fluid to the arrangement 1608. The arrangement 1608 may include any of the arrangement shown in FIGS. 1-15, for example. Any quantity and combination of fluid reservoirs 1606 and arrangements 1608 may be provided.

The arrangement 1608 may include a waste collector that may include an absorbent material, such as fibers, sponge, or similar, to collect fluid.

A terminal 1614 may be provided to the arrangement 1608 to connect jet elements of the droplet ejectors to the control device 1604. The control device 1604 may provide a drive signal to the terminal 1614 to drive the droplet ejectors at the arrangement 1608 to eject fluid droplets.

Another terminal 1616 may be provided to the arrangement 1608 to connect a sensor at the arrangement 1608 to the control device 1604. The control device 1604 may receive from the terminal 1616 a measurement signal indicative of a process carried out at the disposable cartridge 1602.

The control device 1604 may include a processor 1618, a user interface 1620, and an input/output interface 1622.

The user interface 1620 may be connected to the processor 1618 and may include a display, touchscreen, keyboard, or similar to provide output to a user and receive input from the user.

The input/output interface 1622 may be connected to the processor 1618 to provide signal communications between the disposable cartridge 1602 and the processor 1618. The input/output interface 1622 may receive a removeable connection to the terminals 1614, 1616 of the disposable cartridge 1602.

The processor 1618 may include a central processing unit (CPU), a microcontroller, a microprocessor, a processing core, a field-programmable gate array (FPGA), and/or similar device capable of executing instructions. The processor 1618 may cooperate with a non-transitory machine-readable medium that may be an electronic, magnetic, optical, and/or other physical storage device that encodes executable instructions. The machine-readable medium may include, for example, random access memory (RAM), read-only memory (ROM), electrically-erasable programmable read-only memory (EEPROM), flash memory, a storage drive, an optical disc, and/or similar.

The processor 1618 may control the disposable cartridge 1602 to carry out its function by controlling a number of droplet ejectors to activate, a time of droplet ejection by a droplet ejector, a frequency of droplet ejection of a droplet ejector, a combination of such, or similar. The processor 1618 may execute a program by selectively driving droplet ejectors of the arrangement 1608. The processor 1618 may receive output of the process carried out at the disposable cartridge 1602 as a signal that may be used to further control the process at the disposable cartridge 1602 or that may be outputted to the user at the user interface 1620.

A process performed at the arrangement 1608 may be dynamic or time dependent, and the processor 1618 may vary droplet ejector output over time.

The control device 1604 may control the functionality of a variety of different disposable cartridges 1602.

The control device 1604 may include a mechanical feature to removably mechanically receive a disposable cartridge 1602 by way of a mating mechanical feature at the disposable cartridge 1602.

A fluid reservoir 1606 of the disposable cartridge 1602 may be preloaded with a fluid. A fluid reservoir 1606 of the disposable cartridge 1602 may include a fill port 1624 to receive a fluid from an external source, such as a pipette, syringe, or other fluid delivery device. For example, a generic cartridge may be provided for wide range of usage. Then, a particular end user may add their particular fluid of interest, such as a DNA/RNA sample, to such a cartridge.

In view of the above, an array of droplet ejectors may be aimed to provide droplets of ejected fluid to a target medium. A subset of the droplet ejectors may be aimed to miss the target medium and instead may be aimed at another target medium. This may facilitate flexible delivery of fluid to different target media, without the use of a moving mechanism.

It should be recognized that features and aspects of the various examples provided above can be combined into further examples that also fall within the scope of the present disclosure. In addition, the figures are not to scale and may have size and shape exaggerated for illustrative purposes.

The invention claimed is:

1. A device comprising:

a first substrate including a first array of droplet ejectors to eject droplets of a first fluid; and a first target medium immovably positioned relative to the first substrate to receive droplets of the first fluid from a first subset of droplet ejectors of the first array of droplet ejectors, a second subset of droplet ejectors of the first array of droplet ejectors positioned to eject droplets of the first fluid to miss the first target medium.

2. The device of claim 1, further comprising a second substrate including a second array of droplet ejectors to eject droplets of a second fluid, wherein the first target medium is positioned relative to the second substrate to receive droplets of the second fluid from a third subset of droplet ejectors of the second array of droplet ejectors.

3. The device of claim 2, wherein a fourth subset of droplet ejectors of the second array of droplet ejectors is positioned to eject droplets of the second fluid to miss the first target medium.

4. The device of claim 1, further comprising a second target medium positioned relative to the first substrate to receive droplets of the first fluid that miss the first target medium.

5. The device of claim 1, wherein the first substrate is planar and the first target medium is planar, and wherein planes of the first substrate and the first target medium are parallel.

6. The device of claim 1, wherein the first substrate is elongate and the first target medium is elongate, and wherein elongate axes of the first substrate and the first target medium are parallel.

7. The device of claim 1, wherein the first substrate is elongate and the first target medium is elongate, and wherein elongate axes of the first substrate and the first target medium are non-parallel.

8. A disposable cartridge comprising:

a fluid reservoir to contain a first fluid;

a first substrate including a first array of droplet ejectors to eject droplets of the first fluid; and a first target medium immovably positioned relative to the first substrate to receive droplets of the first fluid from a first subset of droplet ejectors of the first array of droplet ejectors.

9. The disposable cartridge of claim 8, further comprising a second target medium, wherein a second subset of droplet ejectors of the first array of droplet ejectors is positioned to eject droplets of the first fluid to the second target medium.

10. The disposable cartridge of claim 8, further comprising a second substrate including a second array of droplet ejectors to eject droplets of a second fluid, wherein the first target medium is positioned relative to the second substrate to receive droplets of the second fluid from a third subset of droplet ejectors of the second array of droplet ejectors.

11. The disposable cartridge of claim 8, wherein the fluid reservoir includes a fill port to receive the first fluid.

12. The disposable cartridge of claim 8, further comprising the first fluid preloaded in the fluid reservoir.

13. A device comprising:

a planar substrate including an array of droplet ejectors to eject droplets of a fluid; and a planar target medium immovably positioned relative to the planar substrate;

the planar substrate oriented at an angle with respect to the planar target medium, such that a subset of droplet ejectors of the array of droplet ejectors is aimed towards the planar target medium.

14. The device of claim 13, wherein the planar target medium includes an additional array of droplet ejectors to eject fluid to an additional target medium.

15. The device of claim 13, wherein the angle is selected to aim another subset of droplet ejectors of the array of droplet ejectors towards another planar target medium.

* * * * *